United States Patent [19]

Gustavsson et al.

[11] Patent Number: 4,932,937

[45] Date of Patent: Jun. 12, 1990

[54] VESSEL FOR SAFE HANDLING OF SUBSTANCES

[76] Inventors: Bengt Gustavsson, Bergsbogatan 29; Lars-Erik Linder, Valebergsvägen 319, both of S-421 79 Vastra Frölunda, Sweden

[21] Appl. No.: 238,977

[22] Filed: Aug. 25, 1988

Related U.S. Application Data

[63] Continuation of Ser. No. 927,590, Nov. 6, 1986, abandoned.

[51] Int. Cl.[5] ..... A61J 1/00

[52] U.S. Cl. ..... 604/87; 206/219; 604/411; 604/416

[58] Field of Search ..... 604/411, 414–416, 604/82, 87, 88, 89, 92, 56; 206/219, 222

[56] References Cited

U.S. PATENT DOCUMENTS

| | | | |
|---|---|---|---|
| 2,849,156 | 8/1958 | Mansted | 604/411 |
| 3,654,926 | 4/1972 | Rietman . | |
| 3,977,555 | 8/1976 | Larson | 604/411 |
| 4,060,082 | 11/1977 | Lindberg et al. | 604/89 |
| 4,187,846 | 2/1980 | Lolachi et al. | 604/411 |
| 4,265,242 | 5/1981 | Cohen . | |
| 4,392,850 | 7/1983 | Elias et al. | 604/414 |
| 4,552,277 | 11/1985 | Richardson et al. | 604/411 |
| 4,564,054 | 1/1986 | Gustavsson | 604/411 |
| 4,576,211 | 3/1986 | Valentini et al. | 604/88 |
| 4,589,879 | 5/1986 | Pearson | 604/416 |
| 4,645,073 | 2/1987 | Homan | 604/414 |
| 4,781,679 | 11/1988 | Larkin | 604/416 |
| 4,785,859 | 11/1988 | Gustavsson | 604/408 |

FOREIGN PATENT DOCUMENTS

| | | | |
|---|---|---|---|
| 135562 | 5/1977 | Denmark . | |
| 0117489 | 9/1984 | European Pat. Off. . | |
| 0126718 | 11/1984 | European Pat. Off. . | |
| 0145825 | 6/1985 | European Pat. Off. . | |
| 1083506 | 12/1954 | Fed. Rep. of Germany | 604/411 |
| 2442856 | 11/1975 | Fed. Rep. of Germany | 128/272.3 |
| WO85/04097 | 9/1985 | PCT Int'l Appl. . | |

OTHER PUBLICATIONS

WO83/03538 Oct. 1983, 604–411 Shield for Connectors–Baxter Traverol Laboratories.

*Primary Examiner*—Stephen C. Pellegrino
*Assistant Examiner*—Ralph Lewis
*Attorney, Agent, or Firm*—Ostrolenk, Faber, Gerb & Soffen

[57] ABSTRACT

A vessel for safe handling of substances and having a first connection member through which the interior of the vessel is accessible by a device, e.g., an injection syringe, for removing or adding material thereto. At least a part of the vessel is expandable and contractable. The vessel is further provided with a second connection member, which is interconnected or interconnectable with the first connection inside the vessel. The second connection member is connectable to a further vessel outside the vessel, so that substance can be transferred directly from the injection syringe to said further vessel via the first and second connection members.

5 Claims, 7 Drawing Sheets

VESSEL FOR SAFE HANDLING OF SUBSTANCES

This is a continuation of application Ser. No. 927,590 filed on Nov. 6, 1986, now abandoned.

TECHNICAL FIELD

The present invention relates to a vessel for safe handling of substances and having a connection member through which the interior of the vessel is accessible by an injection syringe or the like for removing or adding material thereto.

BACKGROUND OF THE INVENTION

When transferring a liquid substance from a vessel, for example a vial by means of an injection needle, or when adding a liquid to a dry substance for dissolving the latter and when further transferring the substance for the intended use, e.g. injection to a patient's blood vessel or to an infusion bottle or the like, one cannot avoid that the injection needle, by which the liquid substance is removed from the vial, gives off aerosols and drops to the environment or that the persons handling the injection needle become contaminated. Especially in cases where the substance consists of cytotoxic drugs, or radio-labelled or allergy-inducing substances, it is for safety reasons important that the transfer of such substances from the vial to a patient, possibly by way of an infusion bottle, takes place under satisfactory conditions and also so that an air contamination of the injection needle during the transfer is avoided. Today vials or ampoules for storage of medicaments and the like are made of glass and the use thereof is associated with drawback. For example, the risk of cuts upon breakage of the ampoule is great. Since glass is a fragile material the vials or ampoules have to be packed very carefully, which requires a complicated and space-requiring handling, storage and transport.

SUMMARY OF THE INVENTION

The purpose of the invention is to provide a vessel, which is cheap and simple to handle, store, transport and manufacture, and which facilitates and makes the transfer of the substance to the patient or other intended use safer. This has been solved by the fact that at least a part of said vessel is expandable and contractable. The vessel is further provided with a second connection member, which is interconnected or interconnectable with said first connection inside the vessel, said second connection member being connectable to a further vessel outside said vessel.

DESCRIPTION OF THE DRAWINGS

FIG. 3 shows the vessel of FIG. 1 and 2 connected to a cannula, vein catheter or the like.

DESCRIPTION OF THE EMBODIMENTS

Figure 1:
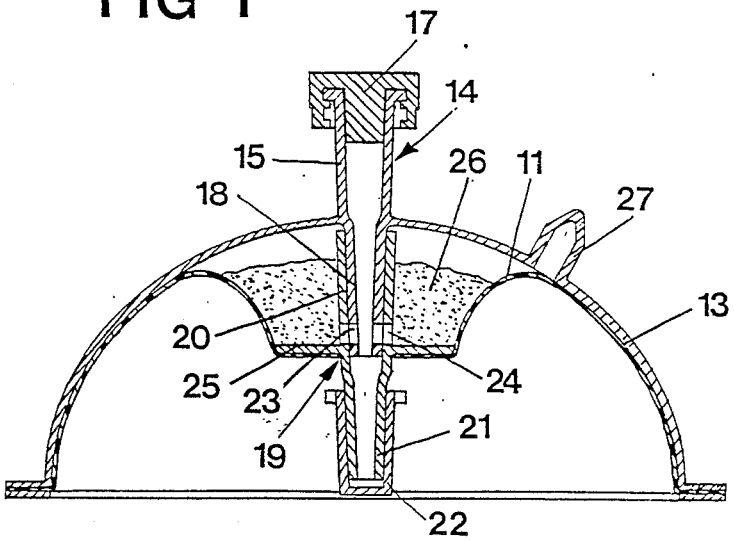
FIG. 1 is a cross-sectional view of a first embodiment of the vessel according to the invention.
Figure 2:
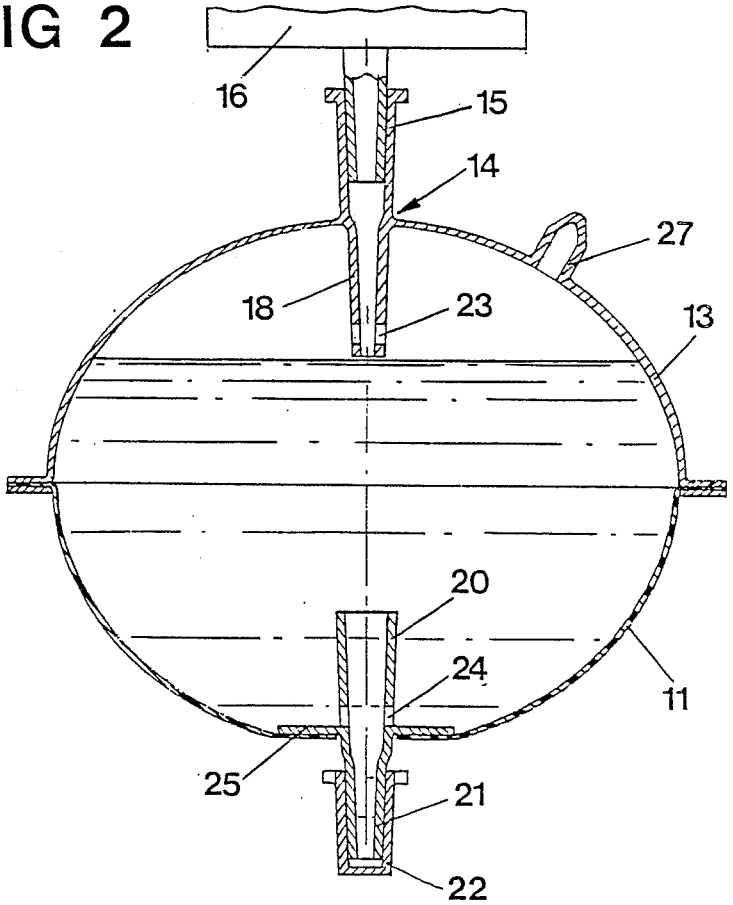
FIG. 2 shows the vessel of FIG. 1, in which the substance has been dissolved by a solvent from an injection syringe connected to the vessel.
Figure 3:
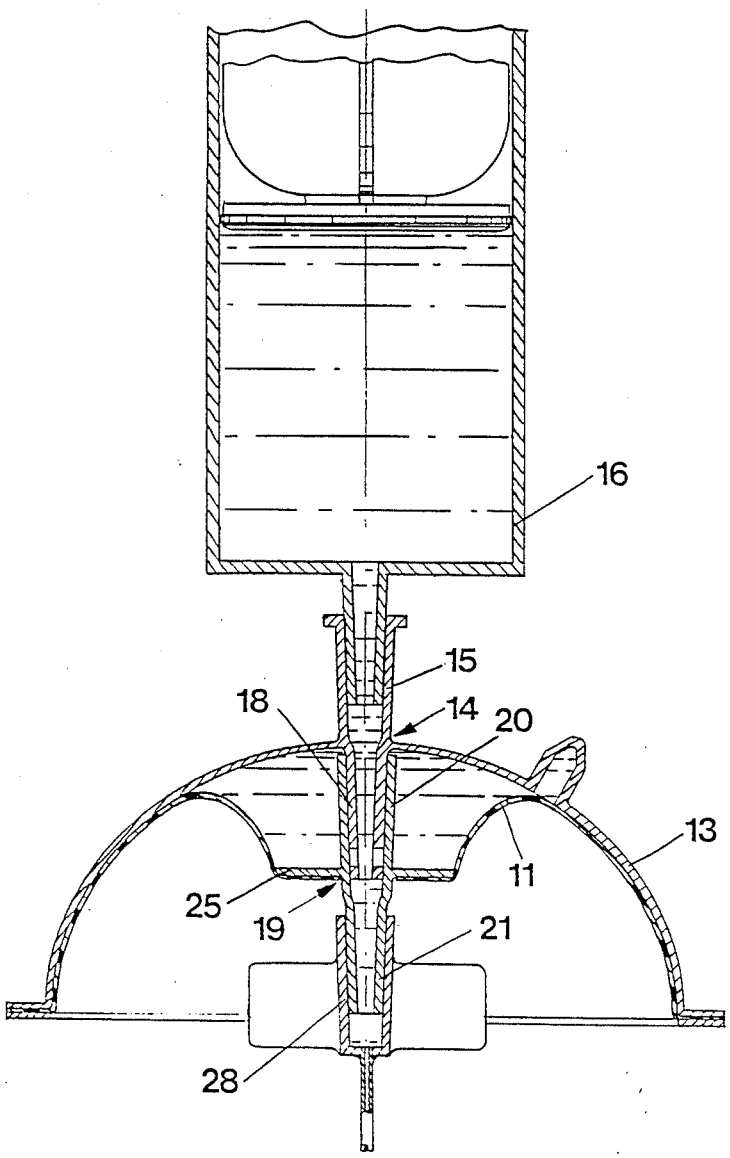

According to the embodiment shown in FIGS. 1–3 the vessel comprises a first part 11 made of a flexible diffusion -tight plastic material and having an open end 12. It further comprises a second part 13 comprising a protective cover of a rigid material. The flexible part 11 and the cover 13 are each part-spherical in shape having the side edges surrounding their openings tightly attached to each other, so that they together define an elliptical or spherical volume.

Many substances are delivered as dry substances, which requires only a very small portion of the volume of the flexible part 11. If the air is evacuated from the flexible part 11 this is sucked into the protective cover against the bottom thereof.

The cover 13 is provided with a first connection member 14 having the shape of a Luer-cone 15 for receiving an injection syringe 16 as shown in FIG. 2. The Luer-cone 15 is sealed by a plug 17, which is removed before the connection of the injection syringe. The first connection member 14 further comprises a male part 18 of a conical coupling extending into the cover 13.

The flexible part 11 is provided with a second connection member 19, comprising a female conical part 20 extending inwards into the vessel and a male conical part 21 sealed by a cap 22. The parts 18 and 20 correspond to each other and can be coupled together in the manner shown in FIGS. 1 and 3. They are further provided with side openings 23 and 24, which initially prior to the position shown in FIG. 1 are located offset from each other and prevent communication between the first connection member 14 and the interior of the vessel. The portion of the flexible part 11 surrounding the second connection member 18 is provided with a stiffening plate 25.

The substance contained in the vessel may consist of a freeze-dried powder 26. A solution of the substance is filled into the vessel, after which the solvent is removed in a freeze-drying process. The solvent vapour is removed through an outlet 27, which then is sealed. In evacuated state the flexible part 11 lies close against the inside of the cover 13 as is shown in FIG. 1, with the dry powder 26 contained in a small volume thereof. This is the condition in which the vessel is delivered and stored.

When the substance 26 contained in the vessel is to be used an injection syringe 16 holding the accurate amount of solvent for dissolving the substance is connected to the first connection member 14 after which the flexible part 11 is slightly twisted with respect to the cover 13, so that the openings 23 and 24 will be located just opposite each other as shown in FIG. 1 and allow communication between the first connection member 14 and the interior of the vessel. After dissolving the substance (FIG. 2) the desired volume of solution is filled into the syringe 16 which permits the vessel to contract again, and the conical parts 18 and 20 are again coupled together, at which time the flexible part 11 is slightly twisted with respected to the cover 13, so that the openings 23 and 24 are again located offset with respect to each other, as shown in FIG. 3. The coupling part 21 can be connected to a corresponding coupling part 28 of a patient's vein catheter, cannula, infusion or transfusion assembly or the like (FIG. 3) and the solution contained in the syringe 16 can be transferred directly through the connection members 14 and 18 to any vessel connected to coupling part 28.

The embodiment of FIGS. 1–3 can be modified and have a first connection member 14 with a membrane, which can be penetrated by a needle attached to a syringe. When the conical parts 18 and 20 are interconnected (FIG. 1) they prevent any contact between the needle and the walls of the flexible part. The second connection member 19 may also be provided with a membrane, which can be penetrated by said needle.

Figure 4:
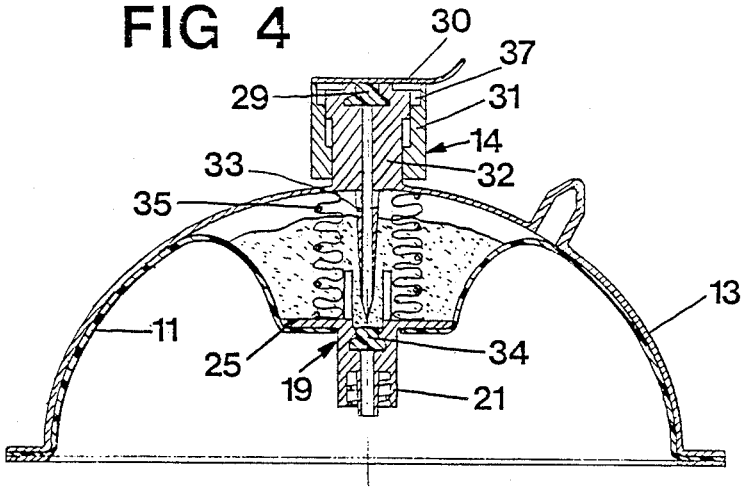
FIGS. 4–6 are cross-sectional views of a second embodiment of the vessel in three different steps of the handling of the substance, similar to the steps shown in FIGS. 1–3.
Figure 5:
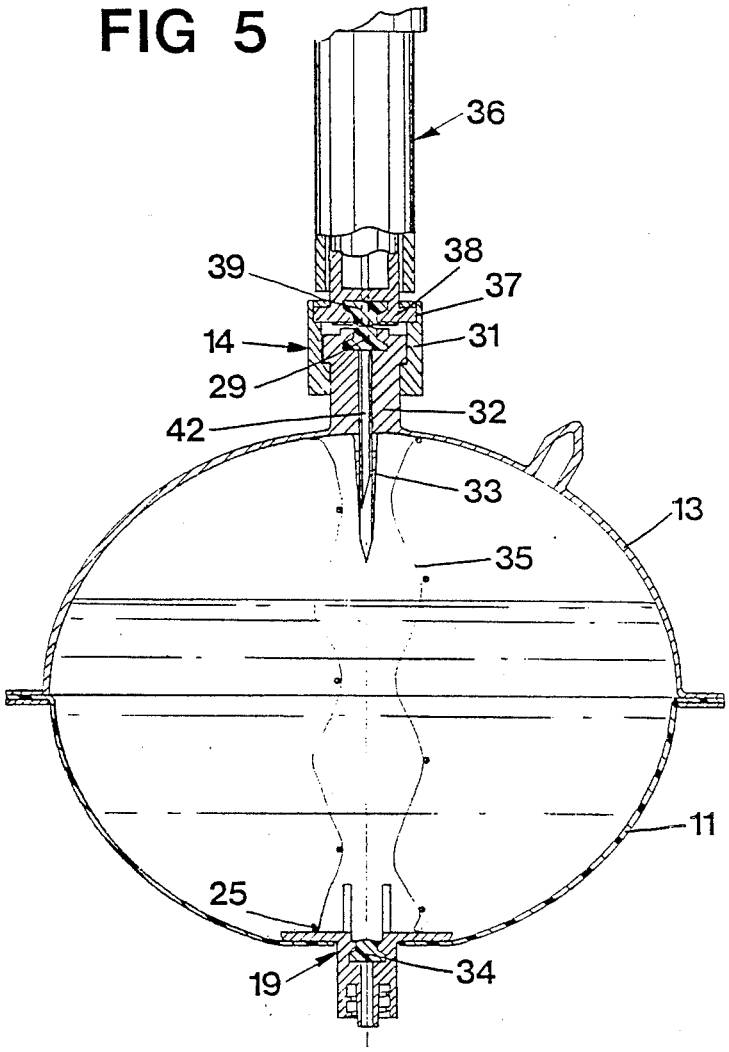
Figure 6:
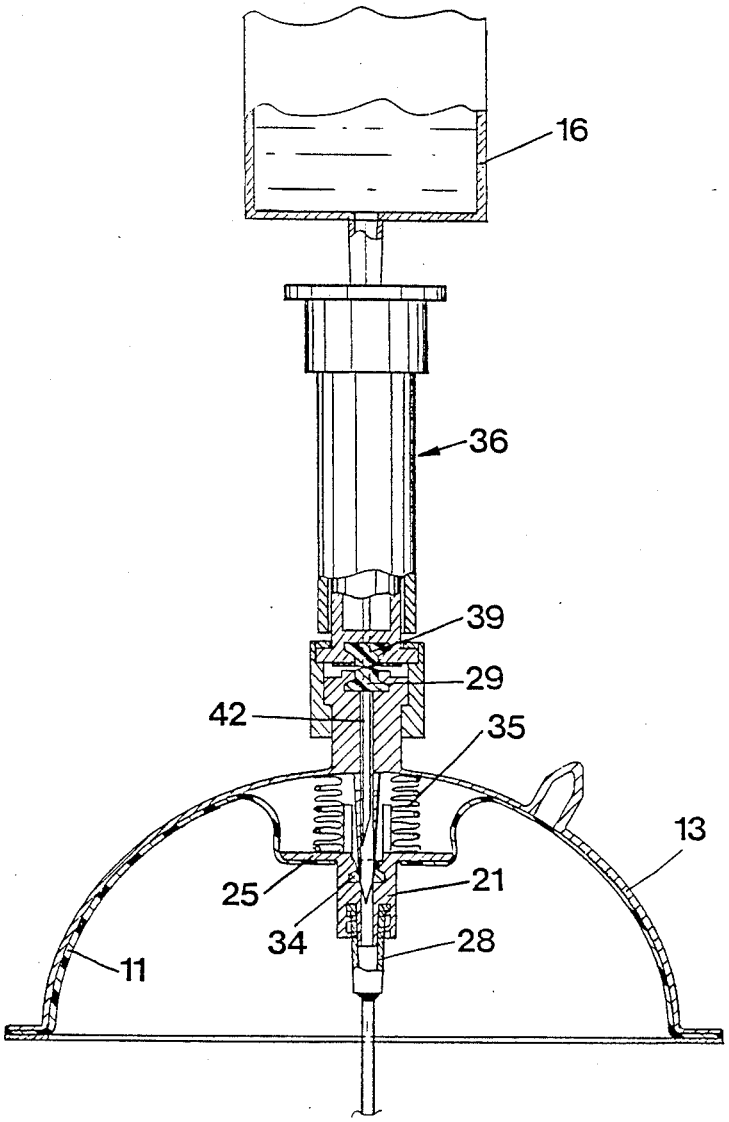

In the embodiment shown in FIGS. 4–6, the first connection member 14 has a membrane 29 covered by a removeable sealing cap 30 or the like. An outer ring-shaped member 31 is telescoped on a cylindrical part 32 of the first connection member. A hollow needle 33 is attached to said cylindrical part 32. After removal of the sealing cap 30 the membrane 16 can be wiped off with an antiseptic solution if desired.

The second connection member 19 is provided with a membrane 34 serving as a sealing. The first and second connection members 14 and 19 are interconnected by a spring member 35. The second connection member 19 is further provided with a coupling part 21 for connection with a corresponding coupling part 28 of a patient's vein catheter, cannula, an infusion assembly or the like.

A needle of an injection syringe may be inserted through the membrane 16 and into the vessel 11, 13 for adding and removing material thereto. However, in cases the substance stored in the vessel is toxic and it is desired to protect the nursing staff from all contact therewith an encapsulated cannula member 36 of the kind shown in U.S. Pat. No. 4,324,030 is connected to the connection member 14 with the ring 31 in extended position as is shown in FIG. 5. The ring 31 has a bayonet coupling 37 corresponding to the coupling means 38 provided on the member 36, which is provided with a membrane 39. When the member 36 is connected to the connection member 14 the membranes 29 and 39 are located close together and prevent any leakage therebetween. An injection syringe may be attached to the encapsulated cannula member 36 for adding solvent to the vessel and removing the dissolved substance therefrom via the cannula 42. The flexible part 11 of the vessel is then returned to its evacuated position inside the protective cover 13 (FIG. 6). By manually pressing the plate 25 supporting the second connection member 21 towards the first connection member 14 against the action of the spring member 35 the needle 33 is brought to penetrate the membrane 34 of the second connection member 19 (FIG. 6). The substance contained in the injection syringe 16 can now be transferred directly to any vessel connected to the coupling part 21. When the manual pressure on the plate 25 is released the needle 33 returns to its position inside the membrane 34 and the coupling parts 21 and 28 can be disconnected.

Figure 7:
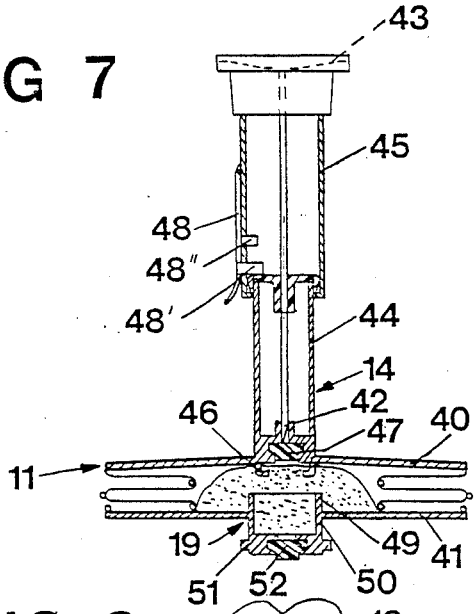
FIGS. 7–9 are cross-sectional views of a third embodiment of the vessel in three different steps similar to the steps according to FIGS. 1–3.
Figure 8:
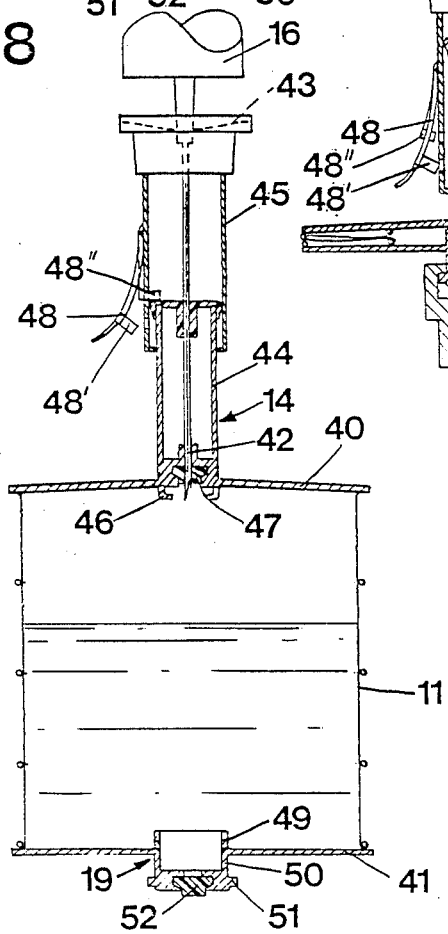
Figure 9:
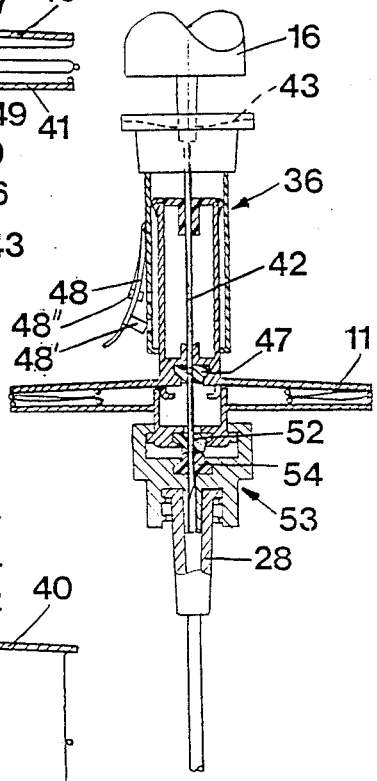

If it is desired to prevent any leakage of substance between the coupling parts 21 and 28 when these are disconnected, the coupling part 21 can be designed in the manner shown in FIGS. 7–9 to permit the connection of a membrane-provided connector 53 coupled to the coupling part 28.

In the embodiment disclosed in FIGS. 7–9 the vessel 11 is designed as a bellows having two rigid end plates 40 and 41 provided with the first and second connection members 14 and 19 respectively. The first connection member 14 comprises an encapsulated cannula member of similar kind as disclosed in FIGS. 5 and 6. It has a lock washer 43 for permanent connection of an injection syringe 16. It further comprises a cannula 42 attached in telescoping members 44 and 45. A short portion 46 of the inner telescoping part 44 extends into the vessel 11 and is at its inner end sealed by a membrane 47. A peg 48 with two locking members 48' and 48'' prevents the telescoping parts from unintentionally being retracted so that the cannula 42 penetrates the membrane 47.

The second connection member 19 has a short inner portion 49 which is interconnectable with the portion 46 of the first connection member 14. It further has an external portion 50 provided with coupling means 51, such as a bayonet coupling, and a membrane 52. The coupling means 51 is connectable to a connector 53, e.g. of the kind disclosed in U.S. Pat. No. 4,564,054, which is connected to a cannula, vein catheter or the like. The connector 53 has a membrane 54.

Upon removing the first locking member 48' of the peg 48 the telescoping members 44 and 45 can be retracted to the position shown in FIG. 8, in which the cannula 42 penetrates the membrane but is prevented to reach the membrane 52. When the substance contained in the vessel 11 has been dissolved by a solvent from the injection syringe 16 and then sucked up into the injection syringe, the portions 46 and 49 of the first and second connection members 14 and 19 are connected, the second locking member 48'' of the peg 48 is removed and the cannula 42 can penetrate the membranes 52 and 54, after which the dissolved substance can be transferred to any vessel connected to the connector 53. After the transfer of the substance the connector 53 and the coupling means 51 of the second connection member 19 are disconnected and the vessel 11 and the injection syringe 16 attached thereto are disposed together as a closed unit avoiding any leakage therefrom.

Figure 10:
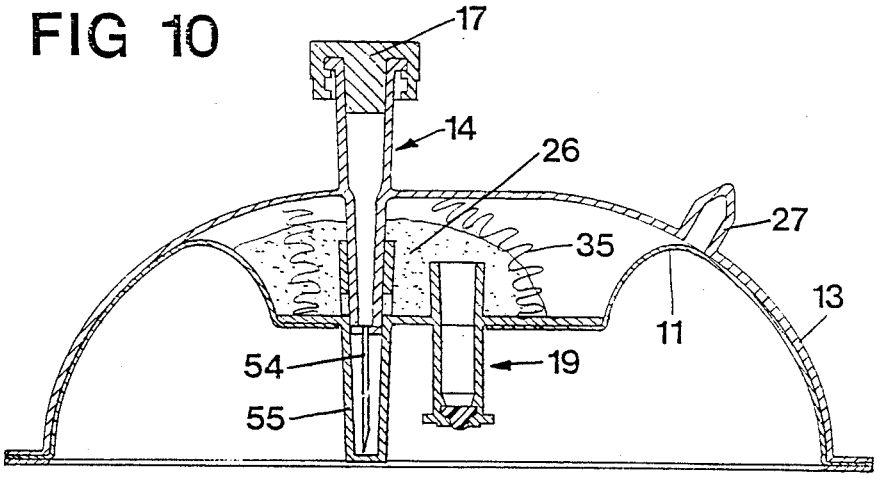
FIGS. 10–12 are sections through a fourth embodiment of the vessel in three different steps similar to the steps according to FIGS. 1–3.
Figure 11:
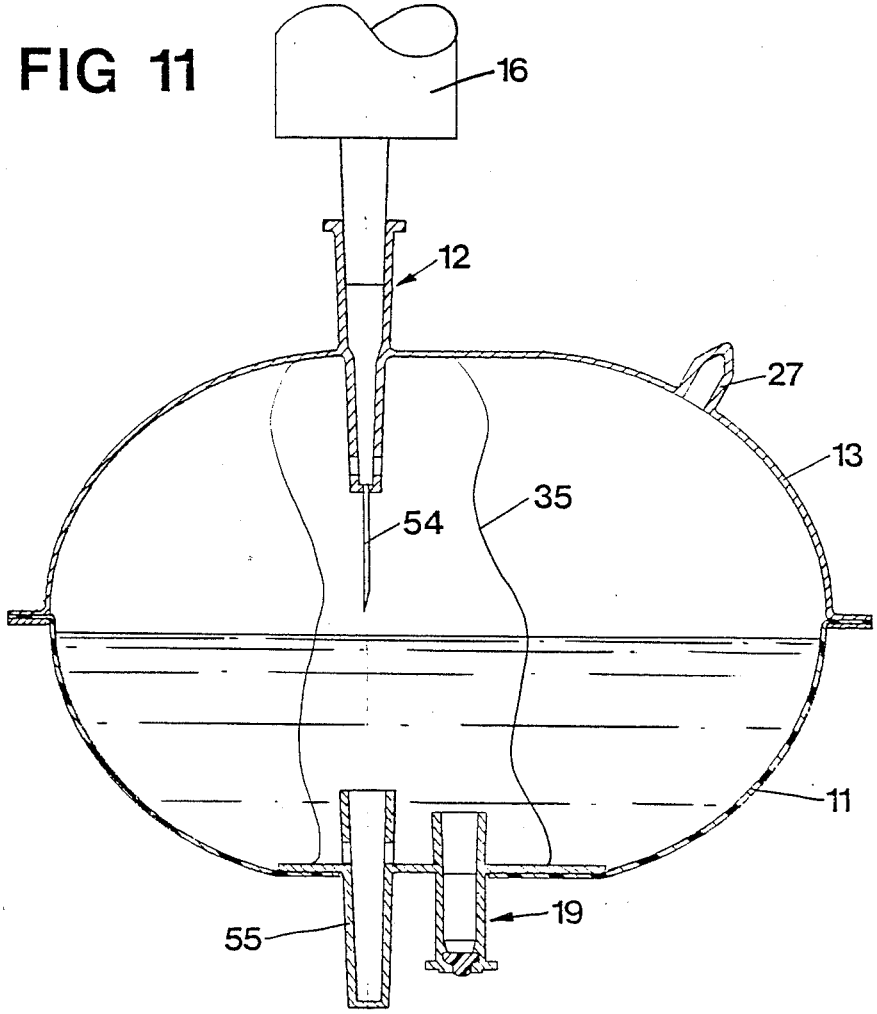
Figure 12:
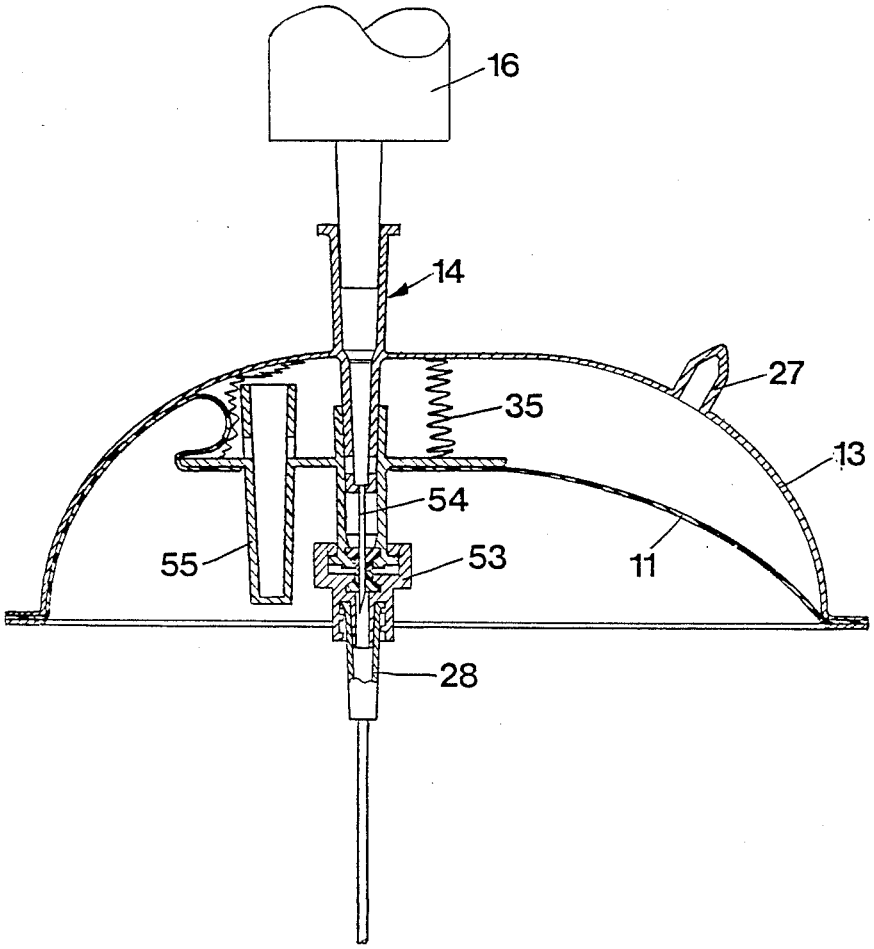

The embodiment disclosed in FIGS. 10–12 in some respects is similar to the one shown in FIGS. 1–3, but differs therefrom by the fact that instead of the coupling part 21, it is provided with a cannula 54, which during transport and storing is received in a rigid protective member 55 located adjacent to the second connection member 19.

The dry substance contained in the vessel 11,13 is dissolved by a solvent from an injection syringe 16 in the corresponding way as described with reference to FIGS. 1–3. The dissolved substance is sucked into the syringe 16 after which the cannula 54 is moved to the second connection member 19. The substance can now be transferred to any vessel connected to the second connection member 19.

The invention is not limited to the embodiments shown and described but a plurality of variants are possible within the scope of the claims. The flexible part 11 can of course be designed in other ways as has been shown here, for example as a plastic bag provided with a rigid plate or the like at the location of the connection members. The injection syringe may further be permanently attached to the first connection member and be delivered as an integrated unit with the vessel.

We claim:

1. A vessel and a material stored therein, said material being in concentrated form such as freeze-dried material, said vessel being adapted for storing said material in an at least partly evacuated condition, said vessel being adapted for storage and transport, said vessel being adapted for dissolving or diluting said material by a solvent;

said vessel comprising;

outer walls defining an inner space for holding said material, at least a part of said outer walls being flexible so that said inner space is expandable and contractible, said concentrated material only taking up a small part of said inner space, said inner space being at least partly evacuated during storage and transport of said vessel;

a first connection member on said outer walls through which said inner space is accessible by a first device containing said solvent, said first device being an injection syringe or the like;

a second connection member on said outer walls opposite said first connection member, said second connection member being operative for connection thereto of a second device, said second device being a cannula, vein catheter, infusion assembly or the like;

said connection members each having an inward portion, said inward portions being interconnectable inside said inner space so as to provide a communication path between said first and second devices when said devices are connected to said first and second connection members and said inner space is contracted;

whereby said material can be handled by adding said solvent into said inner space to dissolve or dilute said material and expand said inner space, and then drawing dissolved or diluted material into said first device and contracting said inner space to permit interconnection of said connection members to form said communication path; and wherein said second connection member is provided with a perforatable sealing member; and further including a puncturing member attached to said first connection member for penetrating the sealing member of said second connection member.

2. The invention of claim 1, wherein a spring member extends between said first and second connection members, said spring member surrounding said puncturing member.

3. The invention of claim 2, wherein the spring force of said spring member is arranged to keep the point of the puncturing member inside the sealing member of the second connection member and that an external pressure is required for bringing said point to penetrate said sealing member.

4. The invention of claim 2, wherein a rigid protective member for receiving a point of the puncturing member is attached to the vessel adjacent to said second connection member, the flexibility of the vessel permitting said point to be moved from said protective member to said second connection member.

5. A vessel and a material stored therein, said material being in concentrated form such as freeze-dried material, said vessel being adapted for storing said material in an at least partly evacuated condition, said vessel being adapted for storage and transport, said vessel being adapted for dissolving or diluting said material by a solvent;

said vessel comprising;

outer walls defining an inner space for holding said material, at least a part of said outer walls being flexible so that said inner space is expandable and contractible, said concentrated material only taking up a small part of said inner space, said inner space being at least partly evacuated during storage and transport of said vessel;

a first connection member on said outer walls through which said inner space is accessible by a first device containing said solvent, said first device being an injection syringe or the like;

a second connection member on said outer walls opposite said first connection member, said second connection member being operative for connection thereto of a second device, said second device being a cannula, vein catheter, infusion assembly or the like;

said connection members each having an inward portion, said inward portions being interconnectable inside said inner space so as to provide a communication path between said first and second devices when said devices are connected to said first and second connection members and said inner space is contracted;

whereby said material can be handled by adding said solvent into said inner space to dissolve or dilute said material and expand said inner space, and then drawing dissolved or diluted material into said first device and contracting said inner space to permit interconnection of said connection members to form said communication path; and wherein said first connection member is provided with a perforatable sealing member; and wherein said first connection member has telescoping parts including one fixed part to which said perforatable sealing member is attached and one movable part having coupling means for connection of an injection syringe or a member attached to an injection syringe; and further including a puncturing member attached to said first connection member for penetrating a sealing member on said second connection member and wherein said puncturing member is received within said telescoping parts in their extended position and in a first retracted position thereof is brought to penetrate the sealing member of the first connection member and in a second retracted position is brought to penetrate the sealing member of the second connection member in the interconnected position of the first and second connection members.

* * * * *